US006942585B1

(12) United States Patent
Krause

(10) Patent No.: US 6,942,585 B1
(45) Date of Patent: Sep. 13, 2005

(54) FOOTBALL TRAINING SLED

(75) Inventor: Harry W. Krause, Rock Hill, SC (US)

(73) Assignee: Rae Crowther Company, Rock Hill, SC (US)

( * ) Notice: Subject to any disclaimer, the term of this patent is extended or adjusted under 35 U.S.C. 154(b) by 40 days.

(21) Appl. No.: 10/335,830

(22) Filed: Jan. 2, 2003

(51) Int. Cl.[7] ..... A63B 69/34
(52) U.S. Cl. ..... 473/445; 473/441
(58) Field of Search ..... 473/422, 438, 473/440–445; 482/83–90, 142

(56) References Cited

U.S. PATENT DOCUMENTS

| | | | | |
|---|---|---|---|---|
| 3,216,724 | A | 11/1965 | Williams | |
| 3,326,553 | A | 6/1967 | Forrest | |
| 3,514,105 | A | 5/1970 | Pillard | |
| 4,087,089 | A | 5/1978 | Forrest | |
| 5,090,696 | A * | 2/1992 | Forrest, Sr. | 473/444 |
| 5,385,523 | A | 1/1995 | Forrest | |
| 5,743,821 | A * | 4/1998 | Wirachowski | 473/441 |
| 6,036,609 | A * | 3/2000 | Gilman | 473/445 |
| 6,599,206 | B1 * | 7/2003 | Forrest et al. | 473/441 |
| 6,685,581 | B2 * | 2/2004 | Krause et al. | 473/445 |
| 2003/0158003 | A1 * | 8/2003 | Corkhill | 473/445 |
| 2003/0216194 | A1 * | 11/2003 | Forrest | 473/441 |

FOREIGN PATENT DOCUMENTS

| | | | | |
|---|---|---|---|---|
| AU | A-48809/93 | * | 4/1994 | A63B 69/34 |

* cited by examiner

*Primary Examiner*—Mitra Aryanpour
(74) *Attorney, Agent, or Firm*—Charles L. Schwab; Nexsen Pruet, LLC

(57) ABSTRACT

A football training sled for improving players blocking skills has an elongated main frame in the shape of a pan with a flat bottom and a tipped up rear end. A dummy module is secured to the front end of the main frame and a single wheel is mounted rearwardly of the front end and midway between the laterally opposite sides of the main frame. When a player strikes and raises the dummy of the dummy module, the front end of the sled is raised so as to be supported on its wheel as the player drives the sled rearwardly. Wings may be provided on the main frame to prevent the sled from being tipped over sideways. In a second embodiment of the invention two dummy modules are supported on the front of the main frame of the sled and a football position device is used to simulate the snap of a football.

13 Claims, 4 Drawing Sheets

FOOTBALL TRAINING SLED

TECHNICAL FIELD

This invention relates to a football training device for training linemen to effectively block opposing players.

BACKGROUND OF THE INVENTION

United States Patent Application Publication No. U.S. 2002/0147061 A1 published Oct. 10, 2002 on an Athlete Training Device invented by myself and Jeffrey Lowery discloses a multiple dummy sled with the dummies positioned about an arc and facing toward the center of the arc. The dummies are spring loaded and are adjustable in height.

A blocking sled with two spring biased dummies is shown in U.S. Pat. No. 3,216,724 issued Nov. 9, 1965 to R. O. Williams for a Football Practice Apparatus.

U.S. Pat. No. 5,383,523 issued Jan. 31, 1995 to C. P. Forrest for a Dual Motion Blocking Sled shows a dummy mounted on a spring biased arm which slides upwardly and rearwardly in a support when an athlete strikes the dummy. The dummy may be lifted upwardly as allowed by a parallel linkage and a multiple position pin which may be positioned to limit up or down swinging movement of the parallel linkage.

U.S. Pat. No. 3,326,553 issued Jun. 20, 1967 to C. P. Forrest for a Multi-Purpose Wheeled Football Training Apparatus shows a tricycle type vehicle with a pair of blocking pads. The rear wheels may be braked simultaneously or individually.

U.S. Pat. No. 4,087,89 issued to C. P. Forrest on May 2, 1978 for a Football Lineman Trainer discloses a multiple dummy sled with retractable wheels at its front and rear. The sled is provided with a laterally shiftable dummy. A roller may be lowered to reduce the blocking force needed to move the sled.

Although a wide variety of football practice sleds have been used, and proposed for use, there is a need for a sled to train blockers which more closely simulates actual playing conditions and which helps to develop proper stance and blocking technique.

BRIEF SUMMARY OF THE INVENTION

It is an objective of this invention to provide a training sled which affords dummy resistance and movement similar to that encountered by a blocking lineman in an actual football game so that the player can develop a good stance and upward blocking strength.

In one embodiment of the invention a spring loaded and vertically adjustable dummy is mounted on the front end of a sled which has a tail end slanting upwardly at a small angle. The sled is about the width of the dummy and includes upward slanting and laterally extending wings which prevent the sled from tipping over sideways. A single wheel is positioned near the center of the sled and is provided with an adjustable brake to vary resistance to rearward sled movement.

In a second embodiment of the invention a two dummy sled includes a front platform for a standing trainer and an upwardly slanting tail having a centrally mounted ground engaging wheel. A football shaped object is secured to the front end of a square section slide rod telescopically supported in a guide at the front end of the sled. A vertical post, with a laterally extending arm at its upper end, is provided to support the rear end of the guide for the slide rod and to provide a stabilizer for the trainer. The trainer grips the slide bar with his right hand and grips the laterally extending arm of the post with his left hand to maintain stability when blockers strike the dummies in response to his rearward movement of the rod and football shaped object.

BRIEF DESCRIPTION OF THE DRAWINGS

Two embodiments of the invention are illustrated in the accompanying drawings, in which.

DETAILED DESCRIPTION OF THE INVENTION

Figure 1:
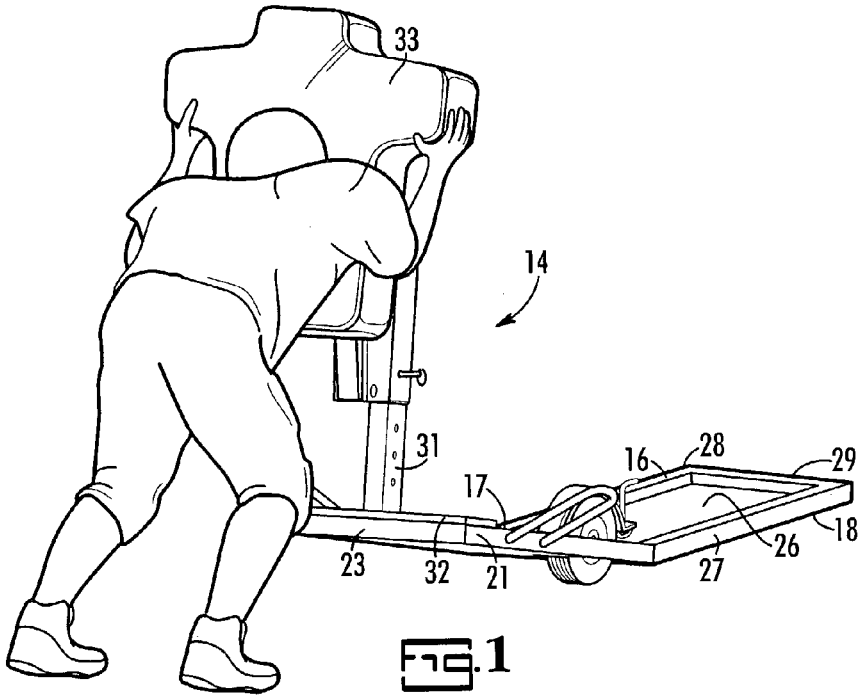
FIG. 1 is a perspective view on a first embodiment of the invention.
Figure 2:
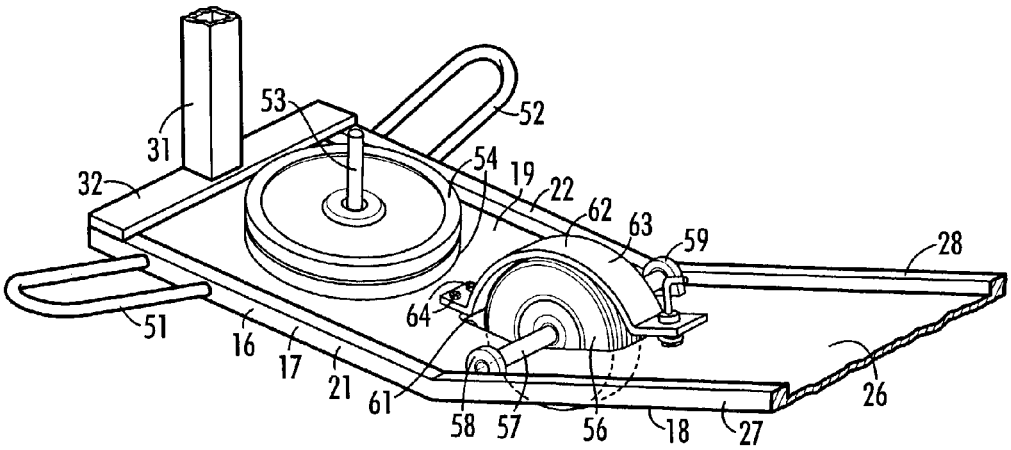
FIG. 2 is a second perspective view of the sled shown in FIG. 1 with parts broken away for illustration purposes.

FIGS. 1 and 2 illustrate a training sled 14 for improving the blocking skills of a single football player. The sled 14 has a longitudinally extending main frame 16 including a front part 17 and a rear part 18. The front part 17 has a flat bottom 19 secured as by welding to side members 21, 22 and a front end member 23. The rear part 18 has a flat bottom 26 secured as by welding to side members 27, 28 and an end member 29. A square section hollow post 31 for supporting a dummy 33 is welded at its bottom end to a transverse beam 32 secured, as by welding, to the side members 21, 22 and the end member 23. The rear end of the front part 17 is welded to the front end of the rear part 18 with the rear part 18 sloping upwardly at an acute angle to the front part 17. The rear part 18 of the main frame tapers in lateral width so that the rear end of the sled 14 is somewhat narrower than its front end.

Figure 4:
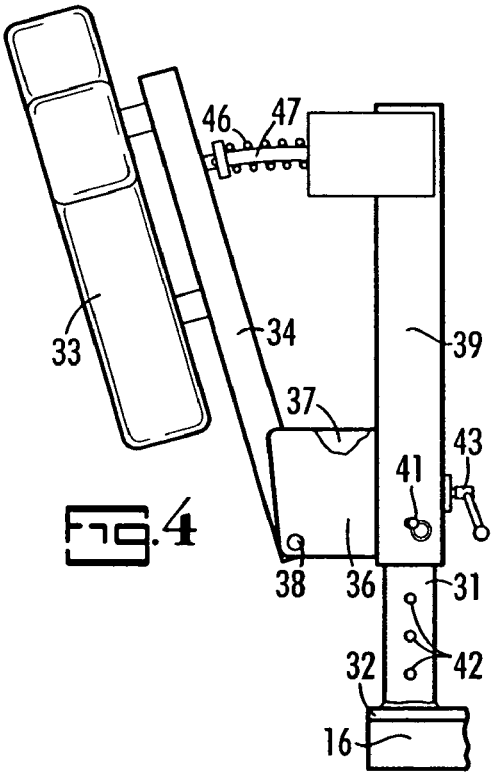
FIG. 4 is a side view of the dummy and dummy support used in the first embodiment of the invention.

As shown in FIG. 1 and FIG. 4, the post 31 is part of a dummy module which also includes a dummy 33 connected to a dummy support in the form of a bar 34 which in turn is pivotally connected at its lower end to a pair of parallel plates 36, 37 by a pin 38. The plates 36, 37 are welded to a column member in the form of a hollow square section tube 39 which is telescopically fitted on the support post 31 in one of a plurality of vertically spaced positions as afforded by inserting a pin 41 in one of a plurality of vertically spaced transverse holes 42 in the post 31. A hand operated set screw 43 is provided to hold the tube 39 and post 31 in tight assembly to prevent rattling during blocking practice. The dummy 33 is spring loaded by a coil spring 46 surrounding a retention bar 47 which limits forward pivotal movement of the dummy 33 but allows rearward swinging movement of the dummy 33 as the coil spring 46 is compressed.

Figure 5:
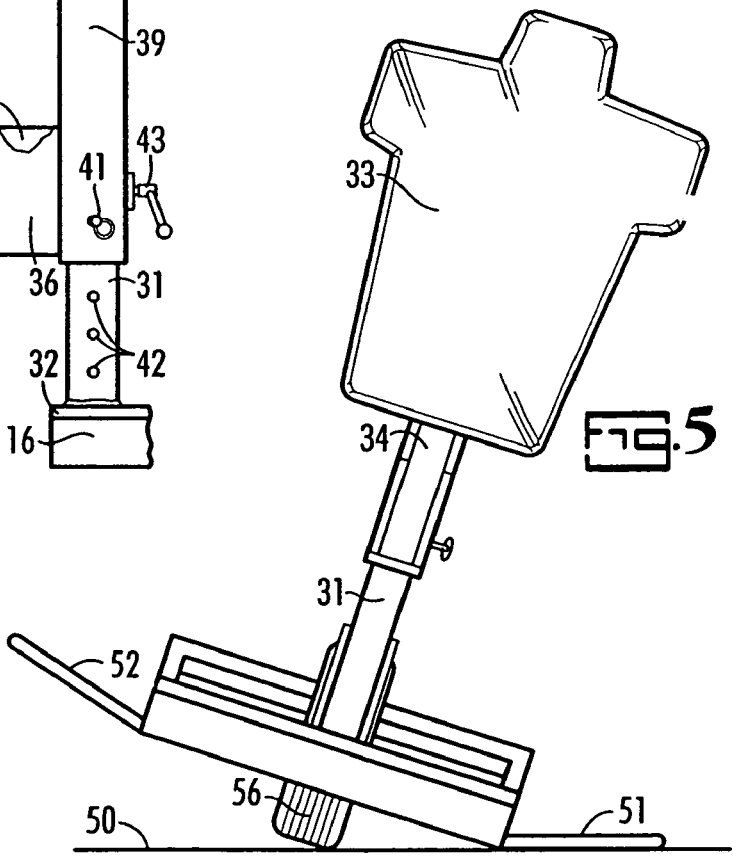
FIG. 5 is a front view of the sled of the first embodiment of the invention showing the sled tipped laterally and supported by one of its laterally extending wings.

Referring to FIG. 2, a pair of U-shaped wings 51, 52, formed from round bar or rod stock, have their ends welded to the side members 21, 22, respectively, so that the wings 51, 52 slope upwardly and laterally outwardly in opposite directions at acute angles to the plane defined by the flat bottom 19 of the front part 17 of the main frame 16. As shown in FIG. 5 the wing 52 has engaged the ground 50 to prevent the sled 14 from tipping over sideways. This position of the sled will occur if the athlete fails to balance the sled 14 on its single narrow tread support wheel 56 during practice blocking A vertical weight position stabilizer 53 is welded at its lower end to the bottom 19 and extends upward through central openings in a selected number of disc shaped weights 54 so as releasably maintain them in their illustrated position on the front of the sled 14.

The sled 14 is provided with a single centrally mounted wheel 56. The wheel 56 is rotatably supported on an axle 57, the opposite ends of which are supported in mounting blocks 58, 59 secured to the bottom 26 of the rear part 18. The wheel 56 is positioned in a central cut out opening 61 in the bottoms 19, 26 where it is disposed midway between the laterally opposite sides of the sled 14.

Figure 3:
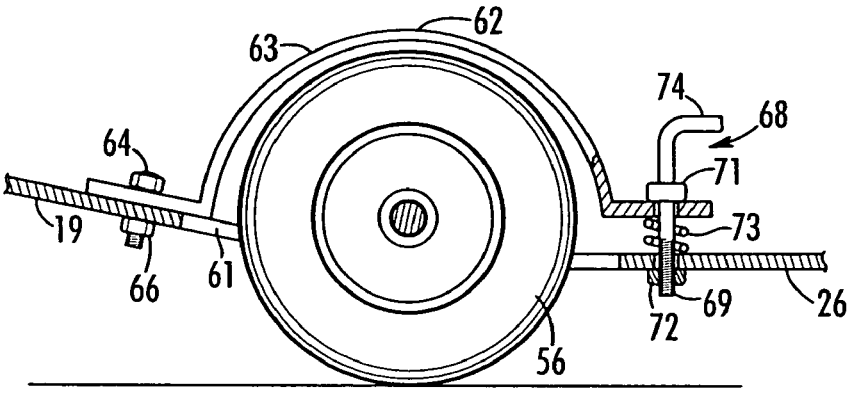
FIG. 3 is a vertical section showing the wheel and a brake used in the embodiment shown in FIGS. 1 and 2.

In order to afford greater resistance to sled movement during training exercises, the sled 14 is provided with an adjustable wheel brake 62, as shown in FIGS. 1 and 3. The wheel brake 62 includes a brake band 63 secured at its front end to the bottom 19 by fasteners in the form of bolts 64 and nuts 66. A brake tension adjusting device 68 is connected to the rear end of the brake band 63. The brake tension device 68 includes a vertically oriented screw 69 having a thrust collar 71 welded thereto above the bottom threaded part of the screw 69. The screw 69 extends through a vertical opening in the rear end of the brake band 63 and an aligned opening in the bottom 26 of the rear part 18 of the sled. The collar 71 is in thrust transmitting engagement with the top side of the rear end of the brake band 62 and the screw is in threaded engagement with a nut 72 welded to the underside of the bottom 26. A back off spring 73 is provided to ensure disengagement of the brake band when free wheeling is desired. A handle 74 on the upper end of the screw 69 permits the trainer to adjust the screw 69 to bring the brake band 63 into engagement with the tread of the wheel 56 to selectively adjust the rotational resistance of the wheel.

Figure 6:
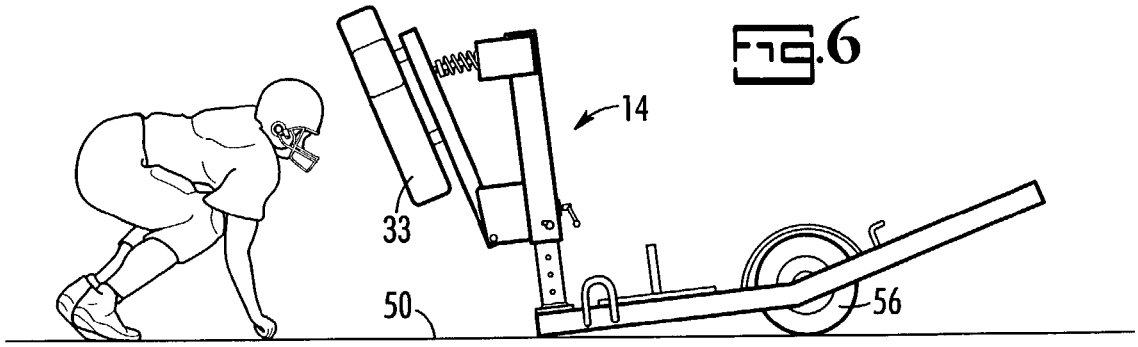
FIGS. 6, 7 and 8 show interaction of a blocker and the training sled of the first embodiment of the invention.
Figure 7:
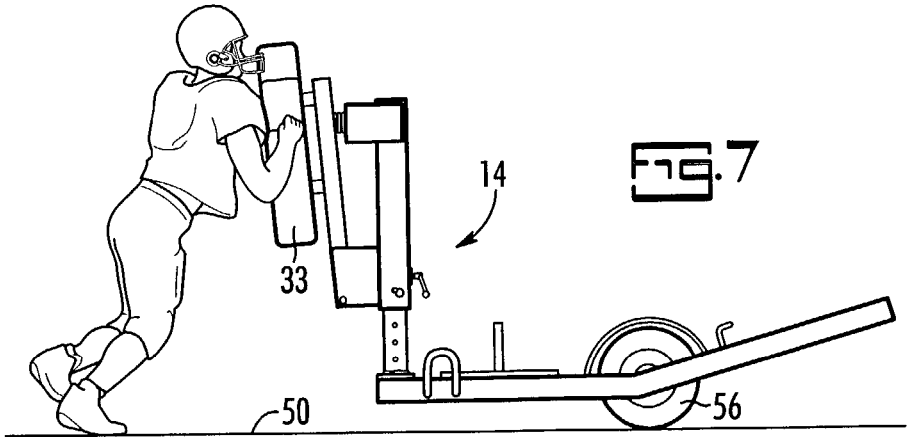
Figure 8:
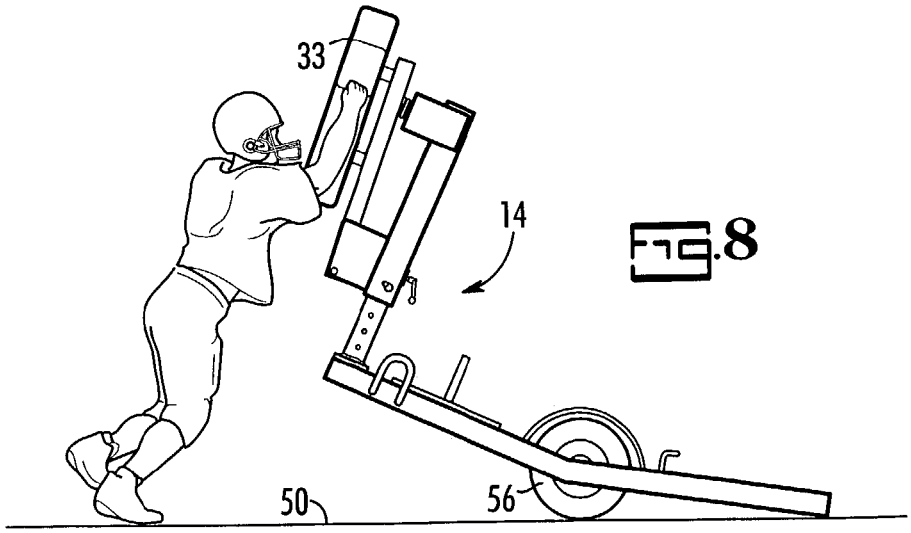

FIG. 6 shows a blocker approaching the dummy 33 on the sled 14. The front part of the sled 14 rests on the ground because the weight of the sled forward of the centrally positioned support wheel 56 is greater than the weight of the sled rearwardly of the support wheel 56, which is positioned intermediate the front and rear ends of the sled. FIG. 7 shows the blocker attacking the dummy 33 with sufficient upward force to raise the front end of the sled 14. In this condition the sled 14 is unstable because it is being balanced on its single ground engaging wheel 56 which is positioned midway between the laterally opposite sides of the main frame 16. The athlete must exert stabilizing force to prevent lateral tilting of the sled 14. This position of the dummy and sled corresponds to forcing an opposing lineman to an upright position. The football player must use a relatively wide stance and continued upward and rearward force to balance the sled and move it rearwardly on the wheel 56 without having the sled tip over sideway. Further upward movement of the dummy, as shown in FIG. 8, corresponds to taking the opposing lineman off his feet, thereby rendering him totally ineffective. In this position of the sled 14 the tail end of the sled strikes the ground 50, thereby preventing it from being tipped over backwards.

Figure 9:
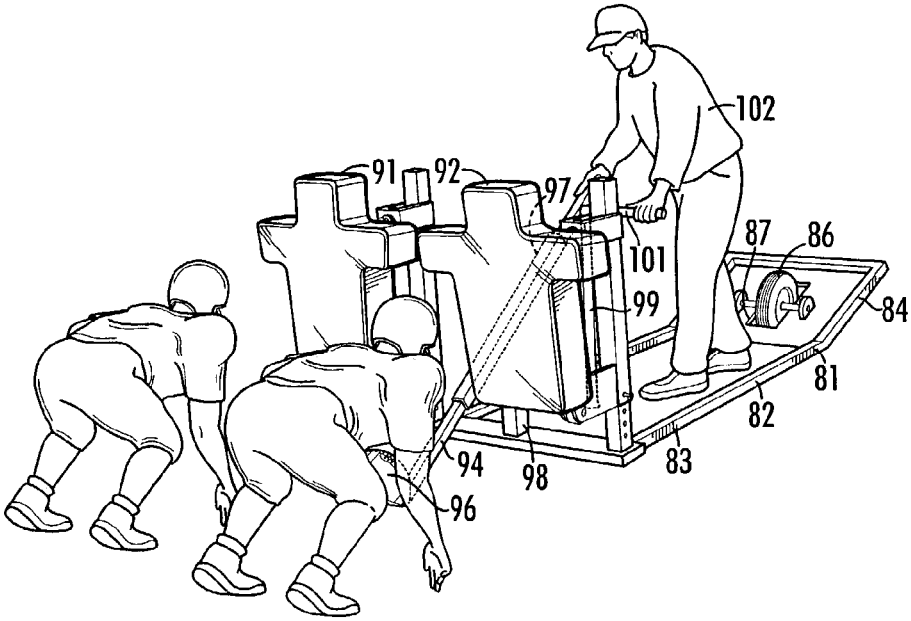
FIG. 9 is a perspective view of the second embodiment of the invention.
Figure 10:
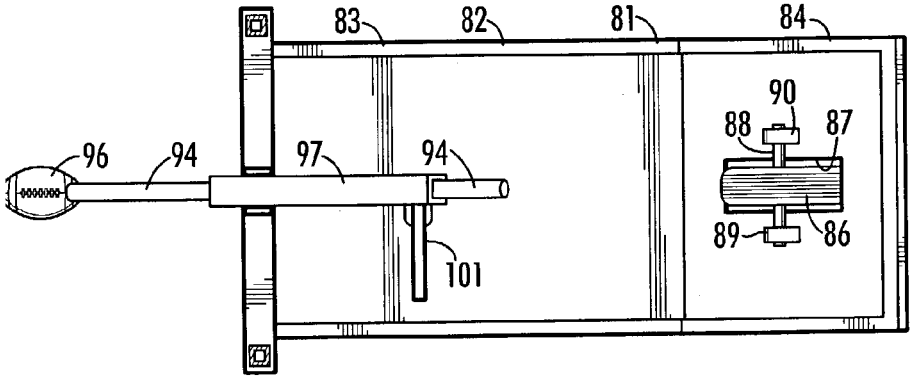
FIG. 10 is a top view of the sled shown in FIG. 9 with parts broken away for illustration purposes.
Figure 11:
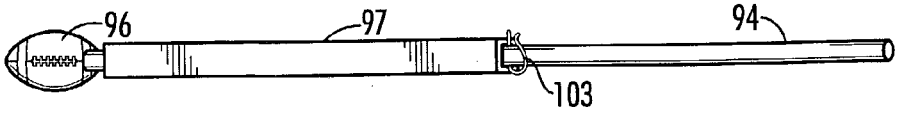
FIG. 11 is a top view of a football positioning device in a retracted position of adjustment.

The second embodiment of the invention illustrated in FIGS. 9, 10 and 11 is a two dummy training sled 81 particularly suited for training a pair of defensive lineman. The sled 81 includes a main frame 82 which includes a flat bottom front part 83 welded at its rear end to the front end of a flat bottom rear part 84, which extends upwardly and rearwardly at an acute angle to the horizon. The rear part 84 rotatably supports a wheel 86 which barely touches the ground when the front part 83 of the main frame is flat on the ground as shown in FIG. 9. Referring to FIG. 10, the wheel 86 extends through a vertical opening 87 in the rear part 84 and is rotatably supported for rotation about a transverse axis by a shaft 88 secured to the bottom of the rear part 84 by mounting blocks 89, 90.

A pair of dummy modules 91, 92 are mounted on the front end of the front part 83 of the main frame 82 at an appropriate lateral spacing from one another to correspond to that of the offensive lineman. In order to emulate the snap of the football a football positioning device is provided. The football positioning device includes a square section rod 94 having a football shaped object 96 rigidly secured to its forward end. The rod 94 extends upwardly and rearwardly in the central vertical plane of the sled at an acute angle to the bottom of the sled and is telescopically supported in that orientation by a square section and hollow guide 97. The guide 97 is rigidly supported on the front part 83 of the main frame 82 by an upright member 98 rigidly secured to the front end of the front part 83 and by an upright support 99 secured as by welding to the flat bottom of the front part 83. The upright support 99 includes an arm 101 extending laterally from its upper end. During training exercises the trainer 102 grips the arm 101 with his left hand and grips the rear end of the rod 94 with his right hand. The square section rod 94 does not rotate in its guide 97. The trainer 102 initiates a training exercise by a sudden rearward movement of the rod 94 causing the football object to move in the same manner as a football snapped by an offensive center. If the defensive linemen apply sufficient upward force on the dummies they can lift the front of the sled off the ground and cause the sled to move rearwardly supported by the single wheel 86 positioned intermediate the front and rear ends of the sled. Proper blocking pressure is required by both blockers to prevent the sled from tipping over laterally. This two dummy sled may be used to train other football players such as offensive linemen by retracting the rod 94 to the position shown in FIG. 11 and releasably securing the rod 94 in the retracted position by use of an appropriate releasable fastener such as a spring pin 103.

PRACTICAL APPLICATION

The training sled illustrated in FIGS. 1–8 is a leverage sled. The player must work in a realistic manner to leverage the dummy and sled upward and then fight the pressure of the sled to keep it upright. The player must explode into the dummy and generate enough force to raise the front of the sled off the ground. Once so lifted, the sled rolls on its single wheel and the player then must balance the sled on the wheel while driving it rearwardly. The player must develop strength and excellent footwork in order to drive the sled and maintain it in an upright posture. If the player's stance is not sufficiently wide the sled will tip to one side or the other.

The adjustable brake allows players at all levels to use the sled. Tighten the brake down for linemen and they will work and develop their explosion into the dummy, their foot base of attack and their hands. The brake may be loosened for receivers and for work on stalk blocks. Without good footwork the player will not be able to control the sled. It will fall to the ground or tip over sideways. Keeping the sled upright requires the coordination of the entire body. The sled is designed so as to tip or fall over and generally lose the player blocking it. The player has to develop quick feet, a good base and upper body strength to control the sled.

With the adjustable height dummy, with weight adjustment by adding or subtracting weight plates and with an adjustable wheel brake, the sled can be used for all levels of players from high school through professional.

The football training sled illustrated in FIGS. 9, 10 and 11 is designed as a defensive two linesman attack sled for teaching defensive players to fire out of their stance and unload their hips. They can't move the sled with just their hands. They must use their entire bodies to hit the dummies and lift them to raise the front of the sled and drive it rearwardly on its wheel. The players must coordinate their efforts to keep the sled balanced on the single wheel. The dummies adjust from one foot to five feet off the ground. This allows players of all sizes to use the sled. They can work from a six, four, three or two point stance. The snapping ball mechanism can be locked in a retracted position, thus allowing the sled to be used without a person standing on it. This lightens the sled for smaller players or allows for different drills such as offensive line drills.

What is claimed is:

1. A football training sled comprising:

a longitudinally extending elongated main frame having a flat bottom floor and longitudinally extending laterally opposite sides, said main frame including a front part having a front end and a rear end and a rear part having a front end rigidly secured to said rear end of said front part and extending rearwardly and upwardly at an acute angle in relation to a plane contiguous to said flat floor of said front part, a single dummy module including:

an upright post rigidly secured to said front end of said front part midway between said laterally opposite sides, and a dummy supported on said upright post, and a single relatively narrow ground engaging wheel mounted in supporting relation to said main frame on a transverse laterally extending axis, said wheel being positioned midway between said laterally opposite sides in longitudinal alignment with said upright post and intermediate said front end of said front part and said rear end of said rear part of said main frame, said wheel rotating about its axis and supporting said sled when said front end of said front part of said sled is raised off the ground by an athlete engaging said dummy.

2. The football training sled of claim 1 wherein said axis is positioned adjacent said junction of said front and rear parts.

3. The football training sled of claim 1 and further comprising wings on laterally opposite sides of said front part extending laterally and upward at an acute angle to a plane contiguous to said flat bottom on said front part, said wings preventing said sled from being tipped over sideways during use in training football athletes.

4. The football training sled of claim 3 wherein said wings are U-shaped rods and the ends of which are rigidly secured to said laterally opposite sides, respectively, of said front part.

5. The football training sled of claim 4 wherein said wings are near said front end of said front part.

6. The football training sled of claim 1 and further comprising an adjustable brake mechanism for said wheel.

7. The football training sled of claim 6 wherein said brake mechanism includes a back-off spring.

8. The football training sled of claim 1 wherein said front part is longer than said rear part.

9. The football training sled of claim 1 and further comprising a vertical column rigidly secured at its bottom end to said bottom of said front part, said column being adapted to receive and hold in place at least one disk shaped weight having a central opening.

10. The football training sled of claim 1 wherein said rear end of said rear part is narrower than said front end of said front part.

11. The football training sled of claim 1 having a column member telescopically mounted on said post, a vertically extending dummy support pivotally connected at its lower end to said column member on a transverse pivot axis, a spring between said dummy support and said column member biasing said dummy to a forwardly inclined position and a motion limiting mechanism operatively associated with said dummy support and said column member limiting pivotal movement of said dummy support in a forward direction.

12. A football training device comprising:

an elongated longitudinally extending main frame having a front end, a rear end, laterally opposite sides and a floor extending between said front and rear ends and between said laterally opposite sides, a single dummy module mounted on said front end of said main frame midway between said laterally opposite sides, the lateral width of said main frame being at least as great as the lateral width of said dummy module, a single relatively narrow ground engaging wheel mounted on said main frame midway between said laterally opposite sides and intermediate its front and rear ends for rotation about a laterally extending axis, said wheel being in longitudinal alignment with said dummy, the weight of said device forward of said wheel being greater than the weight of said device rearward of said wheel, whereby when not engaged in a training exercise said front end of said main frame rests on the ground and said rear end is elevated above the ground, when said dummy is engaged by an athlete with a predetermined upward force, the front end of said main frame is raised off the ground and said device is balanced by said athlete and said single wheel upon application of stabilizing force by said athlete to prevent lateral tilting of said device.

13. The device of claim 12 having a pair of wings secured, respectively, to said laterally opposite sides and extending laterally outwardly and upwardly therefrom at an acute angle to the plane defined by said floor.

* * * * *